US007161336B2

(12) United States Patent
Sakai et al.

(10) Patent No.: US 7,161,336 B2
(45) Date of Patent: Jan. 9, 2007

(54) POWER SUPPLY DEVICE AND ELECTRONIC EQUIPMENT COMPRISING SAME

(75) Inventors: Masaru Sakai, Kyoto (JP); Takuya Okubo, Shimane (JP)

(73) Assignee: Rohm Co., Ltd., Kyoto (JP)

( * ) Notice: Subject to any disclaimer, the term of this patent is extended or adjusted under 35 U.S.C. 154(b) by 308 days.

(21) Appl. No.: 10/943,238

(22) Filed: Sep. 17, 2004

(65) Prior Publication Data

US 2005/0122087 A1 Jun. 9, 2005

(30) Foreign Application Priority Data

Sep. 19, 2003 (JP) ..... 2003-328797

(51) Int. Cl.
*G05F 1/573* (2006.01)

(52) U.S. Cl. ..... 323/271; 323/288; 323/901

(58) Field of Classification Search ..... 323/271, 323/282, 288, 901
See application file for complete search history.

(56) References Cited

U.S. PATENT DOCUMENTS 4,613,810 A * 9/1986 Jablonski et al. ..... 323/271
4,667,144 A * 5/1987 Jones et al. ..... 323/271
4,703,407 A * 10/1987 Fry et al. ..... 365/16
4,964,029 A * 10/1990 Severinsky et al. ..... 363/80
6,281,665 B1 * 8/2001 Miyaba et al. ..... 323/224
6,650,094 B1 * 11/2003 Feldtkeller ..... 323/225
6,841,977 B1 * 1/2005 Huang et al. ..... 323/224
6,969,977 B1 * 11/2005 Smith ..... 323/222
7,023,187 B1 * 4/2006 Shearon et al. ..... 323/266
7,026,801 B1 * 4/2006 Fowler et al. ..... 323/271
7,034,586 B1 * 4/2006 Mehas et al. ..... 327/143

FOREIGN PATENT DOCUMENTS

JP 2001-195884 7/2001

* cited by examiner

*Primary Examiner*—Jeffrey Sterrett
(74) *Attorney, Agent, or Firm*—Arent Fox PLLC

(57) ABSTRACT

The present invention provides a power supply device which can suppress a voltage drop of the input power supply immediately after recovery from shutdown status. The power supply device comprises a reference voltage generation circuit for generating reference voltage (VREF), a transistor for feeding disposed between an input terminal (VTT_IN) and an output terminal (VTT output terminal), a transistor for discharging disposed between a ground potential and a VTT output terminal, a first and second differential amplification circuits for controlling the transistors for feeding and discharging respectively by inputting the output power supply voltage (VTT) as feedback and comparing it with VREF, and a shutdown recovery circuit for generating voltage that gradually starts up by a constant current source and a capacitor, wherein the first differential amplification circuit compares VTT with the voltage (SR) of the shutdown recovery circuit instead of VREF, for a certain period from the point of recovery from shutdown status.

4 Claims, 3 Drawing Sheets

POWER SUPPLY DEVICE AND ELECTRONIC EQUIPMENT COMPRISING SAME

BACKGROUND OF THE INVENTION

1. Field of the Invention

The present invention relates to a push-pull type power supply device suitable for a high-speed memory device and electronic equipment which comprises this power supply device and uses the output thereof for the power supply for termination.

2. Description of the Related Art

Recently the development of memory devices in attempts to further increase data transfer speed is actively on-going as the performance of electronic equipment progresses. Of this equipment, a DDR (Double Data Rate) synchronous DRAM (DDR-SDRAM) has been commercialized, which synchronizes data transfer for both edges, rise and fall, of a clock signal, to increase the data transfer speed of a synchronous DRAM (SDRAM), which operates synchronizing clock signals.

In a DDR-SDRAM, a high-speed interface with small amplitude signals using the power supply voltage for termination and reference voltage, is used for the high-speed data transfer (e.g. Japanese Patent Application Laid-Open No. 2001-195884). FIG. 3 is a partial circuit diagram of an electronic equipment depicting a configuration of this interface. The electronic equipment 49 comprises a controller 51, which is, for example, a microcomputer, DDR-SDRAM 52, and the power supply device for termination 50 for outputting the power supply voltage for termination (VTT). The controller 51 and the DDR-SDRAM 52 are connected by a signal line via a resistor for interface 53, and this signal line and the power supply for termination (VTT) of the power supply device for termination 50 are connected via a resistor for interface 54 at the connection point Ni of the resistor for interface 53 at the DDR-SDRAM 52 side.

In this example, the system power supplies (VDD) of the controller 51 and the DDR-SDRAM 52 are both set to 2.5V, and the power supply voltage for termination (VTT) and the reference voltage (VREF) are both set to 1.25V, and the resistance values of the resistors for interface 53 and 54 are also equalized. The controller 51, of which the output circuit 61 is constructed in a CMOS configuration, outputs 2.5V as high level and 0V as low level. These high and low level voltages are divided by the resistors for interface 53 and 54, and decrease their amplitude to be 1.875V and 0.625V respectively at the connection point N1. These signals with lower amplitude are input to the non-inversion input terminal of the input signal differential amplifier 62 of the DDR-SDRAM 52, and high level/low level is judged at high-speed by comparing with the 1.25V of the reference voltage (VREF) to be input to the inversion input terminal.

In order to implement such a fast interface with small amplitude, the power supply device for termination 50 for outputting the power supply voltage for termination (VTT) and the reference voltage (VREF) are necessary. For the power supply device for termination 50, the power supply device disclosed in Japanese Patent Application No. 2003-307710 is proposed by the present inventor. FIG. 4 shows this power supply device, but in this diagram, the portion related to the offset, which is not directly related to the present invention, is omitted.

This power supply device 101, which is the so called push-pull type, outputs the power supply voltage for termination (VTT) from the power supply voltage output terminal for termination (VTT output terminal) and the reference voltage (VREF) from the reference voltage output terminal (VREF output terminal), and is comprised of a reference voltage generation circuit 106 for generating reference voltage (VREF), a transistor for feeding 111 disposed between the input power supply (VTT_IN) and the VTT output terminal, a transistor for discharging 112 disposed between the ground potential and the VTT output terminal, and the differential amplification circuits 113 and 114 to which the power supply voltage for termination (VTT) is fed back, controlling the transistors for feeding and discharging 111 and 112 respectively by comparing VTT with the reference voltage (VREF). Therefore the differential amplification circuit 113 and the transistor for feeding 111 form a first feedback loop, and the differential amplification circuit 114 and the transistor for discharging 112 form a second feedback loop. A stabilization capacitor 119, for stabilizing the power supply voltage for termination (VTT), is connected to the VTT output terminal.

The reference voltage generation circuit 106 is comprised of resistors 117 and 118 for dividing the voltage of the input power supply (VDDQ) to generate the reference voltage (VREF), and a buffer amplifier 115 for outputting this reference voltage (VREF). The resistors 117 and 118 have equal resistance values. The reference voltage (VREF) is output to the outside from the reference voltage output terminal (VREF output terminal), and also is output to the differential amplification circuits 113 and 114.

In this power supply device 101, the input power supply (VCC) of the differential amplification circuits 113 and 114 and the buffer amplifier 115 are set to 5V, and the input power supply (VTT_IN) of the transistor for feeding 111 and the input power supply (VDDQ) of the resistors 117 and 118 are set to 2.5V, the same as the above mentioned system power supply (VDD) in FIG. 3, by decreasing the voltage from the input power supply (VCC) by a regulator (not illustrated). Therefore the reference voltage (VREF), which is generated by dividing the 2.5V voltage of the input power supply (VDDQ) by the resistors 117 and 118, becomes 1.25V. The above mentioned first and second feedback loops function so as to match the power supply voltage for termination (VTT) to this reference voltage (VREF) 1.25V.

SUMMARY OF THE INVENTION

In this way, this power supply device 101 can output the power supply voltage for termination (VTT) and reference voltage (VREF).

The above mentioned electronic equipment 49, which uses a fast interface with small amplitude signals using the power supply voltage for termination (VTT) and reference voltage (VREF), generally has the so called shutdown function, that is, a function for decreasing the power consumption by simply maintaining the current status when the equipment is not operating. At this time, the output of the power supply voltage for termination (VTT) is controlled to be OFF status (floating status) according to the shutdown signal (SW) from the device for judging the timing of entering shutdown status (not illustrated). The reference voltage (VREF), on the other hand, is continuously output without coming under the control of the shutdown signal (SW), so that the current status of the DDR-SDRAM 52 is maintained. This method is called "suspend to RAM".

The power supply device 101, according to this method, receives a low level of the shutdown signal (SW) in the shutdown status, for example, and turns OFF the transistor for feeding 111 and the transistor for discharging 112. By this, the stabilization capacitor 119 discharges naturally, therefore the power supply voltage for termination (VTT) drops according to the natural discharge, and eventually reaches the level of the ground potential.

Shutdown status is cleared by receiving a high level of the shutdown signal (SW), for example, and the transistor for feeding 111 changes from OFF status to ON status by the above mentioned first feedback loop. The transistor for discharging 112 is maintained in OFF status by the activation of the above mentioned second feedback loop. FIG. 5 shows the waveform of the voltage or current of each unit immediately after recovery from this shutdown. When recovery from shutdown status ($t_0$) occurs, the transistor for feeding 111 changes from OFF status to ON status, and charging current (ITT) flows in from the input power supply (VTT_IN) to the stabilization capacitor 119 via the transistor for feeding 111, so that the power supply voltage for termination (VTT), which has been in the level of the ground potential, is matched with the reference voltage (VREF). In this case, the voltage difference between the power supply voltage for termination (VTT), which has been dropped to the ground potential level, and the reference voltage (VREF), is large, and the transistor for feeding 111 feeds the maximum current thereof, that is, enters full ON status. Also the capacity value of the stabilization capacitor 119 is generally high, e.g. about 220 μF, so the charging current (ITT) flows through the transistor for feeding 111 for a relatively long time. As a result, the drop in the voltage of the input power supply (VTT_IN) becomes quite large.

At this time, the input power supply (VDDQ) is also connected to the input power supply (VTT_IN), so the voltage thereof also drops, and the reference voltage (VREF) as well drops considerably from the normal voltage. As a result, the assurance (tolerance) of normal operation of DDR_SDRAM 52, to which the reference voltage (VREF) is input, decreases, and in an extreme case, the occurrence of a malfunction is a concern.

With the foregoing in view, it is an object of the present invention to provide a power supply device for controlling the charging current that flows through the transistor for feeding immediately after recovery from the shutdown status, so as to suppress the voltage drop of the input power supply, and the electronic equipment using this power supply device.

To solve the above problem, the power supply device according to the present invention is a power supply device for outputting output power supply voltage from an output terminal, comprising: a reference voltage generation circuit for generating reference voltage; a first transistor disposed between an input power supply and an output terminal; a second transistor disposed between a ground potential and an output terminal; a first and second differential amplification circuits for controlling the first and second transistors respectively by inputting the output power supply voltage as feedback, and comparing it with the reference voltage that is input from the reference voltage generation circuit; and a shutdown recovery circuit for generating voltage that gradually starts up, wherein the first differential amplification circuit compares the output power supply voltage with the voltage of the shutdown recovery circuit instead of the reference voltage, for a certain period from the point of recovery from the shutdown status.

The electronic equipment according to the present invention is an electronic equipment comprising this power supply device, a memory device and a controller, wherein the memory device and the controller are connected by at least one signal line via a first resistor, and the output terminal of the power supply device is connected to the memory device side of the signal line via a second resistor as a power supply for termination.

In the power supply device according to the present invention, the first differential amplification circuit controls the transistor for feeding (first transistor) by comparing the voltage, which gradually rises from the shutdown recovery circuit, and the output power supply voltage (power supply voltage for termination) immediately after recovery from shutdown, so the charging current that flows through the transistor for feeding becomes roughly constant, and the voltage drop of the input power supply is suppressed to almost zero. The electronic equipment according to the present invention enables a highly secure operation, eliminating the possibility of malfunction caused by a voltage drop of the input power supply immediately after recovery of shutdown by using this power supply device.

DESCRIPTION OF THE PREFERRED EMBODIMENTS

Figure 1:
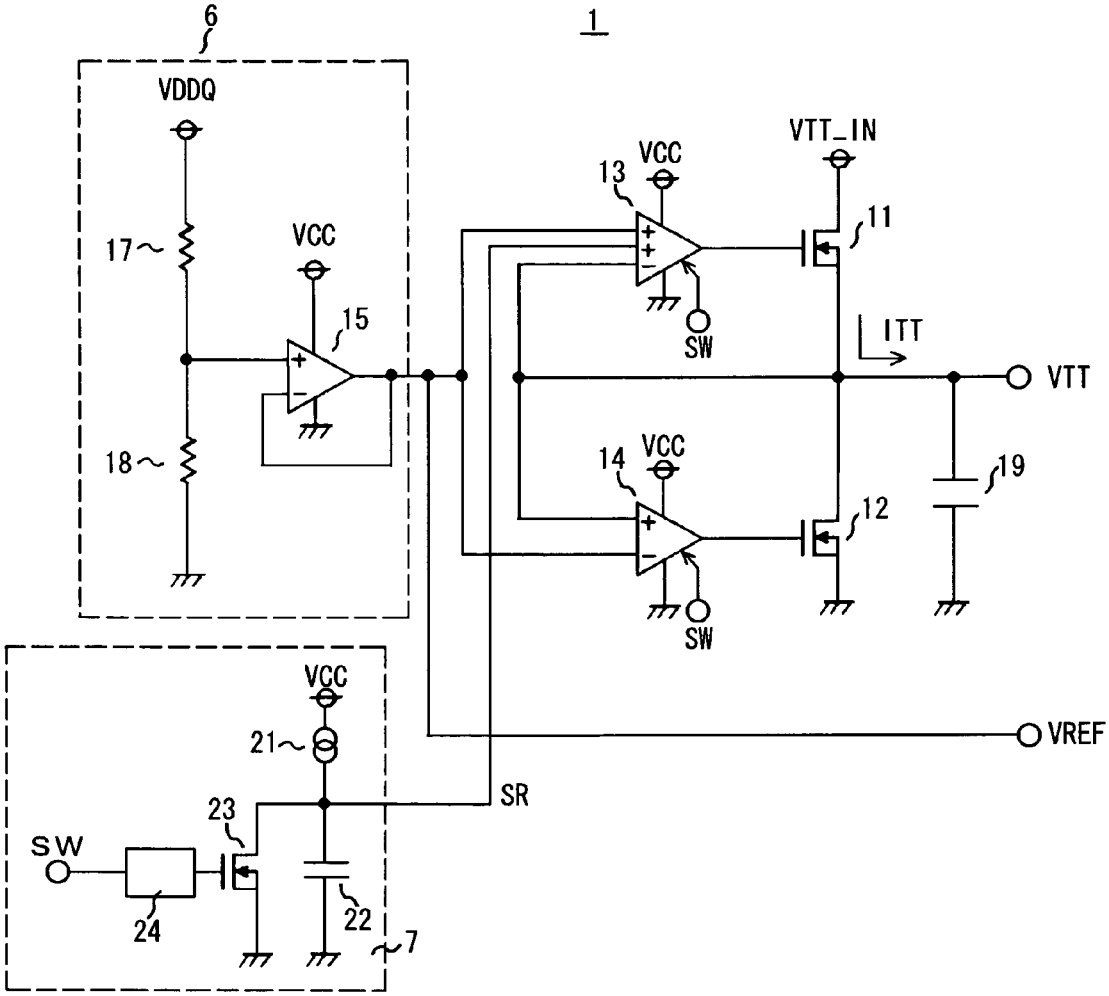
FIG. 1 is a circuit diagram depicting the power supply device according to the embodiment of the present invention.

Embodiments of the present invention used for the above mentioned electronic equipment shown in FIG. 3 will now be described with reference to the drawings. FIG. 1 is a circuit diagram of the power supply device 1 which is an embodiment of the present invention.

The power supply device 1 which is a so called push-pull type, just like the power supply device 101 of the related art, outputs the output power supply voltage, that is the power supply voltage for termination (VTT) from the power supply voltage output terminal for termination (VTT output terminal) and the reference voltage (VREF) from the reference voltage output terminal (VREF output terminal), and comprises a reference voltage generation circuit 6 for generating reference voltage (VREF), an NMOS type transistor for feeding (first transistor) 11 disposed between the input power supply (VTT_IN) and the VTT output terminal, an NMOS type transistor for discharging (second transistor) 12 disposed between the ground potential and the VTT output terminal, and first and second differential amplification circuits 13 and 14 for controlling the first and second transistors 11 and 12 respectively by inputting the power supply voltage for termination (VTT) as feedback and comparing it with the reference voltage (VREF). The first differential circuit 13, however, further comprises a separate non-inversion input terminal to which the output voltage of the later mentioned shutdown recovery circuit is input, in addition to the non-inversion input terminal to which the reference voltage (VREF) is input. And when voltage is input to both of these two non-inversion input terminals, the lower voltage value thereof is compared with the power supply voltage for termination (VTT). The stabilization capacitor 19, for stabilizing the power supply voltage for termination (VTT), is connected to the VTT output terminal, also just like the power supply device 101.

The reference voltage generation circuit 6 is comprised of resistors 17 and 18 for generating the reference voltage (VREF) by dividing the voltage of the input power supply (VDDQ), and a buffer amplifier 15 for outputting this reference voltage (VREF), which is also the same as the power supply device 101. The resistors 17 and 18 have an equal resistance value. The reference voltage (VREF) is output to the outside from the reference voltage output terminal (VREF output terminal), and is also output to the first and second differential amplification circuits 13 and 14.

In addition to the above configuration, the power supply device 1 further comprises a shutdown recovery circuit 7 for generating voltage (SR) which gradually rises by the constant current source 21 and capacitor 22. And the first differential amplification circuit 13 compares the power supply voltage for termination (VTT) with the voltage (SR) from the shutdown recovery circuit 7 instead of the reference voltage (VREF), for a certain period from a point of recovery from the shutdown status. At shutdown, a shutdown signal (SW), which is low level, is input to the first and second differential amplification circuit 13 and 14, and the gates of the first and second transistors 11 and 12 are set to ground potential level, and are turned OFF.

The shutdown recovery circuit 7 further comprises a one shot pulse generator 24 for generating a one shot pulse when the shutdown status is recovered, that is when the shutdown signal (SW) changes from low level to high level, and a transistor 23, which receives the one shot pulse and temporarily sets the output voltage of the shutdown recovery circuit 7 to the ground potential level.

Figure 3:
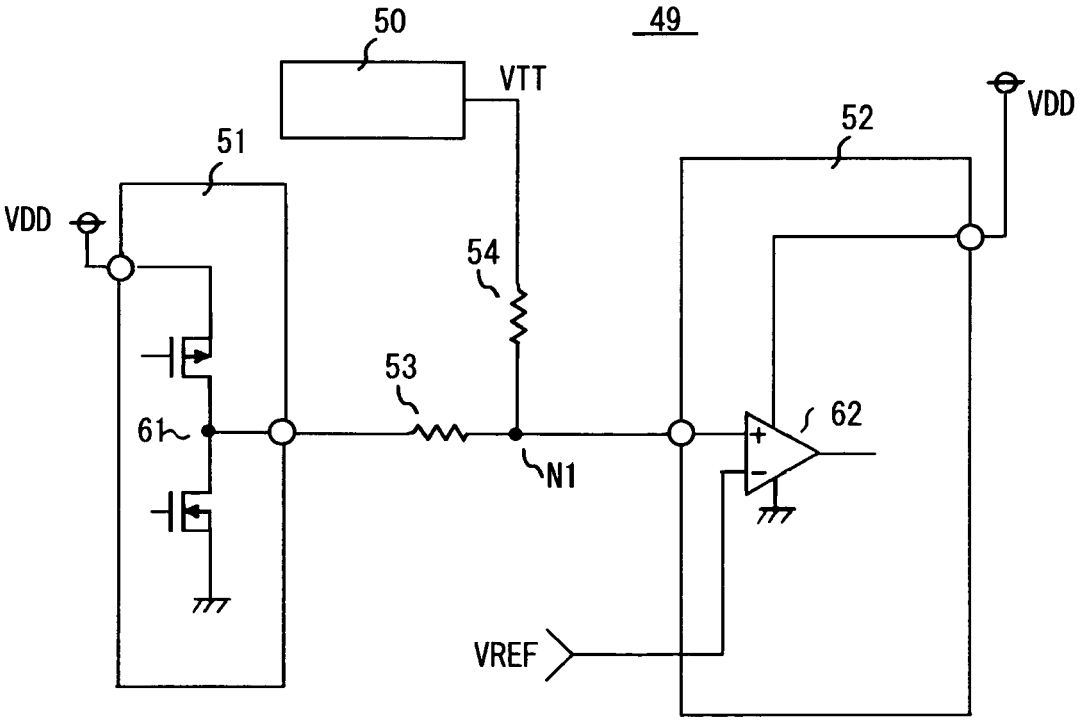
FIG. 3 is a partial circuit diagram of the electronic equipment constituting the fast interface with small amplitude signals.
Figure 4:
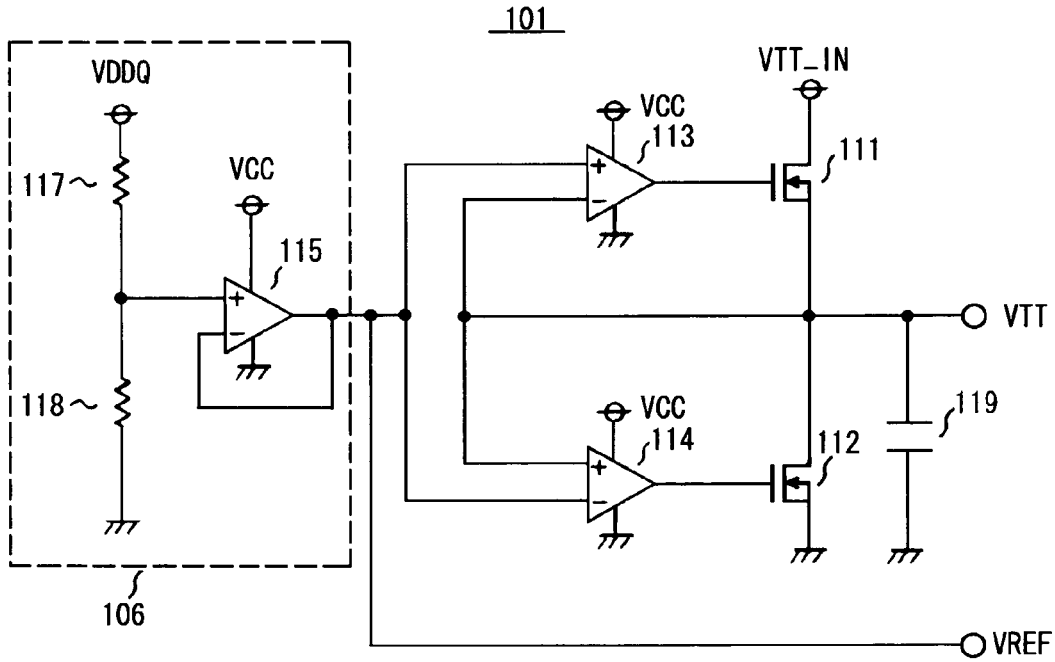
Fig. 4 ( Related art )
FIG. 4 is a circuit diagram depicting the power supply device according to a related art.
Figure 5:
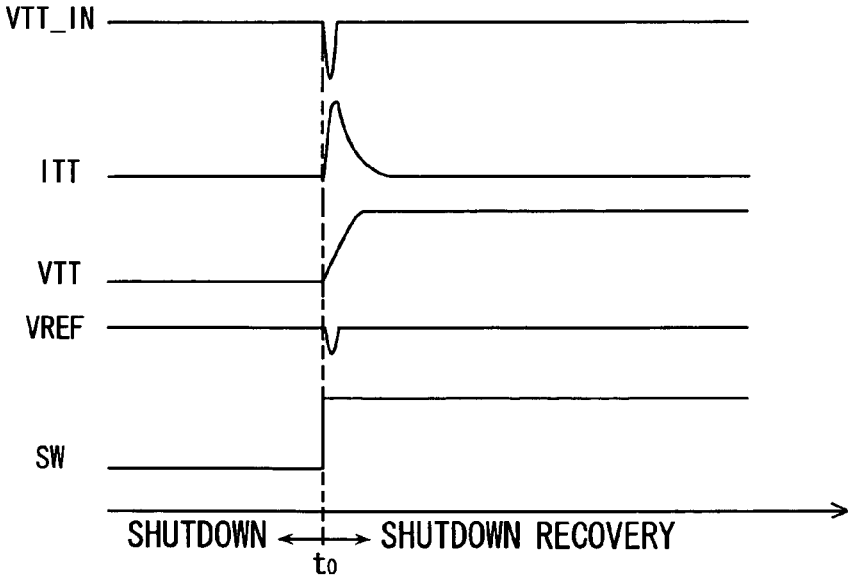
FIG. 5 is a waveform diagram immediately after recovery from shutdown of the above power supply device of related art.

In this power supply device 1, the voltage of the input power supply (VCC) for the first and second differential amplification circuits 13 and 14, the buffer amplifier 15 and the shutdown recovery circuit 7 are set to 5V, and the voltage of the input power supply (VTT_IN) of the transistor for feeding 11 and the power supply (VDDQ) to be input to the resistors 17 and 18 are dropped from the voltage of the input power supply (VCC) by the regulator (not illustrated), and are set to 2.5V, which is the same as the above mentioned system power supply (VDD) in FIG. 3.

Also, just like the power supply 101, the first differential amplification circuit 13 and the first transistor 11 form the first feedback loop, and the second differential amplification circuit 14 and the second transistor 12 form the second feedback loop. After a certain period has elapsed from the point of recovery from the shutdown status, that is during normal time, the first and second feedback loops function so as to match the power supply voltage for termination (VTT) with the reference voltage (VREF). During the certain period from the point of recovering from the shutdown status, the first and second feedback loop function as described below.

Figure 2:
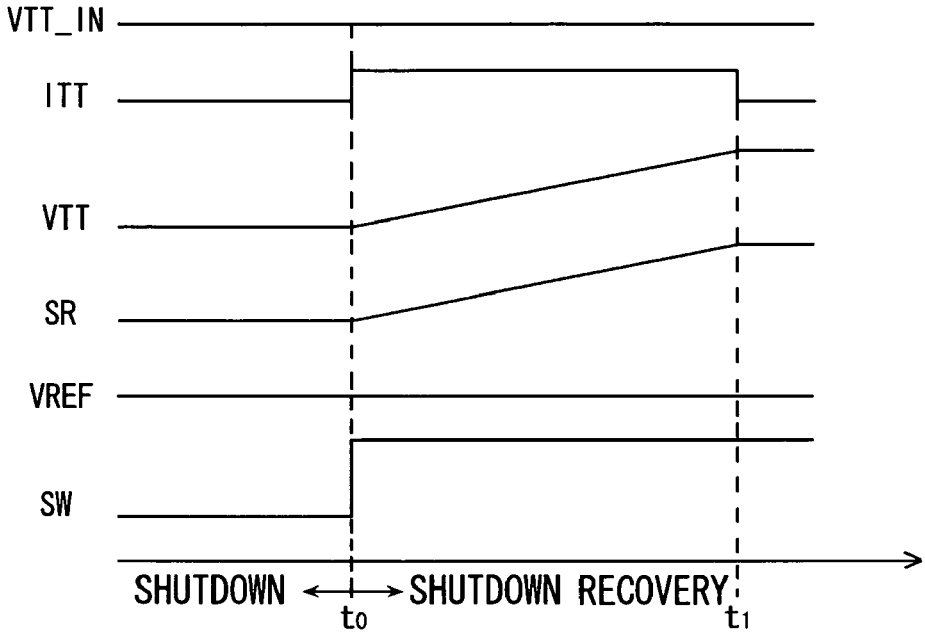
FIG. 2 is a waveform diagram immediately after recovery from shutdown of the above power supply device.

Now the operation immediately after recovery from the shutdown status will be described with reference to FIG. 2.

When the shutdown signal (SW) changes from low level to high level ($t_0$), the shutdown status is cleared, and the above mentioned first and second feedback loops activate. At the same time, in the shutdown recovery circuit 7, the one shot pulse generator 24 generates a one shot pulse, and the transistor 23, which received the one shot pulse, temporarily sets the output voltage thereof (SR) to the ground potential level. Then by flowing a constant current from the constant current source 21 to the capacitor 22, the voltage (SR), which gradually rises from the ground potential level, is generated and is output to the non-inversion input terminal of the first differential amplification circuit 13. In the first differential amplification circuit 13, the lower one of the voltage to be input to the two non-inversion input terminals, that is the reference voltage (VREF) and voltage (SR) of the shutdown recovery circuit 7, is compared with the power supply voltage for termination (VTT) to be input to the inversion input terminal, so the voltage (SR) of the shutdown recovery circuit 7 and the power supply voltage for termination (VTT) are compared until the point ($t_1$), where the voltage (SR) of the shutdown recovery circuit 7 exceeds the reference voltage (VREF). And the above mentioned first feedback loop activates, and the power supply voltage for termination (VTT) follows up the voltage (SR) from the shutdown recovery circuit 7 via the first transistor 11 which is in ON status. In this way, the power supply voltage for termination (VTT) also gradually rises from the ground potential level. The second transistor is maintained in OFF status until the point ($t_1$), since the reference voltage (VREF) and the power supply voltage for termination (VTT) are compared in the above mentioned second feedback loop.

Since the voltage (SR) of the shutdown recovery circuit 7 is generated by flowing the constant current from the constant current source 21 to the capacitor 22, the rising rate thereof is roughly constant. And the power supply voltage for termination (VTT) follows up the voltage (SR) of the shutdown recovery circuit 7, so the current (ITT) that flows through the first transistor 11, that is the charging current of the stabilization capacitor 19, also becomes roughly constant. Therefore the voltage drop of the input power supply (VTT_IN) is suppressed to almost zero. As a consequence, the voltage drop of the input power supply (VDDQ) is also almost zero, and the reference voltage (VREF) hardly deviates from the normal voltage.

After the point ($t_1$) where the voltage (SR) of the shutdown recovery circuit 7 exceeds the reference voltage (VREF), that is during normal operation, the first and second feedback loops activate to compare the reference voltage (VREF), which is relatively lower than the voltage (SR), and the power supply voltage for termination (VTT).

In the first and second differential amplification circuits 13 and 14, it is free to add an offset voltage to the power supply voltage for termination (VTT) to be input or to the reference voltage (VREF) to be input, or to create a predetermined difference between the reference voltages (VREF) to be input respectively to the first and second differential amplification circuits 13 and 14, as disclosed in Japanese Patent Application No. 2003-307710.

This power supply device 1 can be used for the electronic equipment 49, which was described with reference to FIG. 3 in the "Description of the Related Art" section. In other words, the power supply device 1 is used as the power supply device for termination 50 in FIG. 3. The controller 51 and the DDR-SDRAM 52 are connected with a signal line via the first resistor for interface 53, and this signal line and the VTT output terminal of the power supply device 1 are connected at the connection point Ni of the resistor for interface 53 at the DDR-SDRAM 52 side via the second resistor for interface 54. The output of the VREF output terminal of the power supply device 1 is input as the reference voltage (VREF) of the input signal differential amplification circuit 62 of the DDR-SDRAM 52. In this way, a high-speed interface with small amplitude signals can be implemented in the electronic equipment shown in FIG. 3.

In the electronic equipment 49 using this power supply device 1, the reference voltage (VREF) hardly deviates from the normal value even immediately after the recovery from shutdown status, so the possibility of a malfunction caused by the voltage drop in such as DDR-SDRAM 52, to which the reference voltage is input, is eliminated, and a highly secure operation can be achieved.

The power supply device for outputting the power supply voltage for termination (VTT) and the reference voltage (VREF), and the electronic equipment using this power supply device were described above as an embodiment of the present invention, but needless to say, the power supply device of the present invention can also be applied to other cases where the output terminal corresponding to the VTT output terminal exists, and can also be used for other electronic equipment.

The present invention is not limited to the above mentioned embodiments, but the design thereof can be modified in various ways within the scope of the issues stated in the claims.

What is claimed is:

1. A power supply device for outputting output power supply voltage from an output terminal, comprising:

a reference voltage generation circuit for generating reference voltage;

a first transistor disposed between an input power supply and an output terminal;

a second transistor disposed between a ground potential and an output terminal;

a first and second differential amplification circuits for controlling the first and second transistors respectively by inputting output power supply voltage as feedback and comparing it with the reference voltage that is input from the reference voltage generation circuit; and a shutdown recovery circuit for generating voltage that gradually starts up, wherein said first differential amplification circuit compares the output power supply voltage with the voltage of the shutdown recovery circuit instead of the reference voltage, for a certain period from the point of recovery from shutdown status.

2. The power supply device according to claim 1, wherein said shutdown recovery circuit generates voltage that starts up gradually by a constant current source and a capacitor.

3. An electronic equipment comprising the power supply device according to claim 1, a memory device, and a controller, wherein the memory device and the controller are connected by at least one signal line via a first resistor, and the output terminal of the power supply device is connected to the memory device side of the signal line via a second resistor as a power supply for termination.

4. An electronic equipment comprising the power supply device according to claim 2, a memory device, and a controller, wherein the memory device and the controller are connected by at least one signal line via a first resistor, and the output terminal of the power supply device is connected to the memory device side of the signal line via a second resistor as a power supply for termination.

* * * * *